US005184993A

United States Patent [19]

Dowdeswell

[11] Patent Number: 5,184,993

[45] Date of Patent: Feb. 9, 1993

[54] AQUATIC EXERCISE ASSEMBLY

[76] Inventor: M. Richard Dowdeswell, 356 Pimlico Rd., Greenville, S.C. 29607

[21] Appl. No.: 887,593

[22] Filed: May 20, 1992

Related U.S. Application Data

[63] Continuation of Ser. No. 664,324, Mar. 4, 1991, abandoned.

[51] Int. Cl.[5] ..... A63B 21/06

[52] U.S. Cl. ..... 482/106; 482/92; 482/111

[58] Field of Search ..... 482/44, 49, 50, 55, 482/79, 80, 92, 93, 105, 106, 108, 109, 110, 111, 39; 441/55-59

[56] References Cited

U.S. PATENT DOCUMENTS

| | | | |
|---|---|---|---|
| 3,463,486 | 8/1969 | James, Jr. | 272/123 |
| 3,781,007 | 12/1973 | Baker et al. | 272/123 |
| 3,913,908 | 10/1975 | Speyer | 272/123 |
| 4,029,312 | 6/1977 | Wright | 272/122 X |
| 4,076,236 | 2/1978 | Ionel | 272/123 |
| 4,089,528 | 5/1978 | Green | 272/122 |
| 4,311,306 | 1/1982 | Solloway | 272/122 X |
| 4,361,324 | 11/1982 | Baroi | 272/123 |
| 4,623,142 | 11/1986 | MacKechnie | 272/116 |
| 4,819,951 | 4/1989 | Solloway | 272/116 |
| 4,905,991 | 3/1990 | Alston | 272/119 |
| 4,913,422 | 4/1990 | Elmore et al. | 482/106 |
| 4,995,604 | 2/1991 | Lynch et al. | 272/122 |
| 5,033,739 | 7/1991 | MacKechnie | 272/116 |

OTHER PUBLICATIONS

Article in "Playthings," Jun., 1958, p. 125.

*Primary Examiner*—Robert Bahr

*Attorney, Agent, or Firm*—Bailey & Hardaway

[57] ABSTRACT

A novel assembly for aquatic exercise utilizing a rod of various lengths upon which foam rubber discs can be mounted which are water absorbent so as to weigh a predetermined amount when fully saturated, which come in various sizes, and which are held onto the rod by end caps. The rods may also be interchanged with floats for aquatic exercise.

3 Claims, 2 Drawing Sheets

AQUATIC EXERCISE ASSEMBLY

This application is a continuation of application Ser. No. 07/664,324, filed Mar. 4, 1991 now abandoned.

BACKGROUND OF THE INVENTION

This invention relates generally to the assembly of an exercise system. More particularly, this invention relates to an exercise assembly for use in water.

Various techniques exist within the prior art for exercising while in water. U.S. Pat. No. 4,685,667 discloses the use of plate-like resistance members which era removed through water for aquatic exercise. U.S. Pat. No. 4,627,613 also concerns aquatic exercise and discloses various types of aquatic exercise systems including a barbell-like design utilizing fins, balls and blades.

Whereas the prior art provides techniques for aquatic exercise, most of these techniques are based on water resistance to motion of some apparatus through the water. The development of the novel system herein described is significant to the field and noteworthy according to its distinguishing features.

The present invention provides an improved aquatic exercise system which includes plastic rods and foam rubber discs of various sizes mounted upon the rod. The discs are water absorbent so as to be heavy when saturated. Various combinations of these discs can be used with rods of various lengths for aquatic exercise.

Reference herein is made to U.S. Pat. No. 4,936,804 issued to Applicant, which teaches aquatic floats with variable buoyancy. The present invention includes rods which are interchangeable with the floats of the prior patent, the floats being mountable upon rods of the present invention.

SUMMARY OF THE INVENTION

It is thus an object of this invention to provide a novel assembly for aquatic exercise.

It is also an object of this invention to provide such a novel assembly for aquatic exercise such that rods of the present invention are interchangeable with floats of U.S. Pat. No. 4,936,804.

It is a further object of this invention to provide such a novel assembly for aquatic exercise which is adaptable for a variety of aquatic activities.

These as well as other objects are accomplished by a plastic, open-ended rod, of various lengths, upon which foam rubber discs are mounted. The discs are water absorbent so as to increase in weight a predetermined amount when fully saturated. Various other advantages and features will become apparent from the following description given with reference to the various figures of drawings.

DETAILED DESCRIPTION

In accordance with this invention it has been found that an improved aquatic exercise system includes plastic rods and foam rubber discs of various sizes. The plastic rods are of various lengths, but all with an identical diameter. The foam rubber discs are water absorbent so as to increase in weight to a predetermined amount when fully saturated. This feature enables a person to exercise in water with this exercise system. Discs according to this invention can also be compressed for shipping. When mounted on the rods, the foam rubber discs are held in position by end caps which twistably attach to the ends of the rods.

Further in accordance with the present invention, the rods are interchangeable with floats disclosed by U.S. Pat. No. 4,936,804. This dual purpose of the rods enables a user to exercise using the rods with either foam rubber discs mounted thereon or floats as taught by the prior patent.

Figure 1:
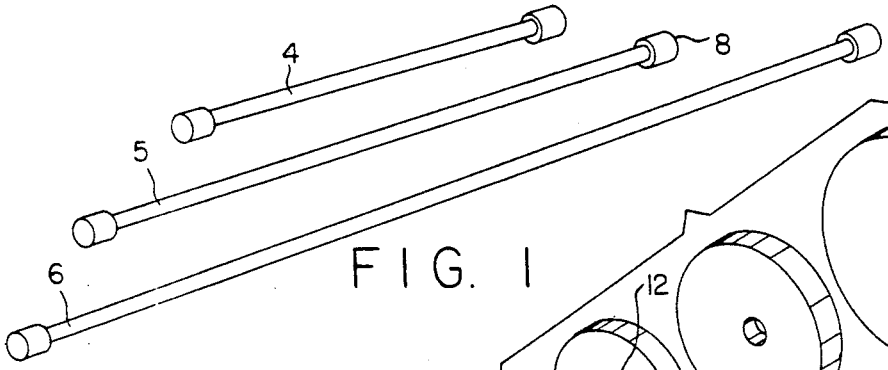
FIG. 1 of the drawings is a front view of sample rods and end caps in accordance with this invention.

Referring now to FIG. 1 of the drawings, hollow rods 4, 5 and 6 are shown, with each rod having open ends covered with plastic end caps 8. Rods 4, 5 and 6 all have identical diameters, but different lengths, rod 4 being a small rod, rod 5 a medium rod, and rod 6 being a long length rod. End caps 5 are twistably detachable.

Figure 2:
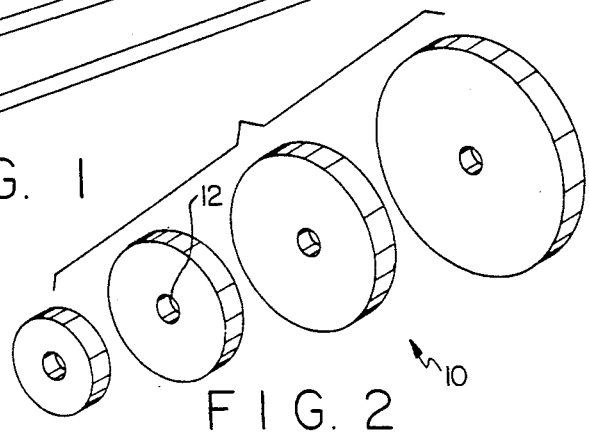
FIG. 2 of the drawings is a perspective view of sample foam rubber discs that are water absorbent and have circular openings in their center so as to mount onto a rod in accordance with this invention.

Referring now to FIG. 2 of the drawings, thick discs 10 are shown of various sizes which are formed from foam rubber and are water absorbent. Each disc has an identical circular opening 12 in its center so as to mount concentrically onto a rod in various combinations. Each disc 10 increases in weight to a predetermined amount when fully saturated and can be wrung out to dry after each use.

Figure 3:
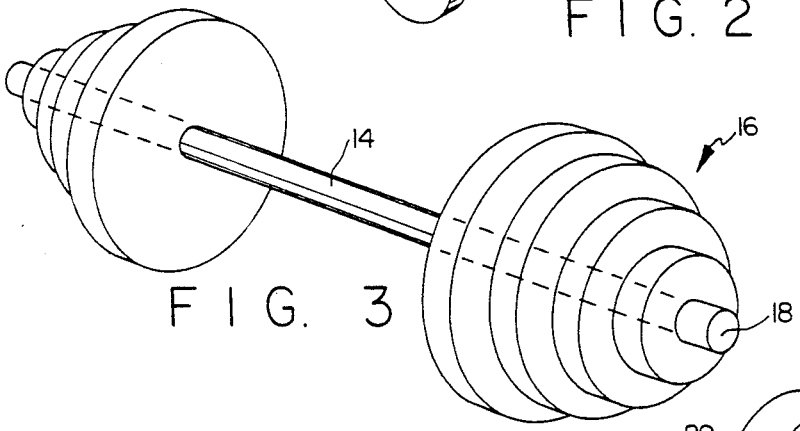
FIG. 3 of the drawings is a perspective view of a sample combination of the aquatic exercise assembly.

FIG. 3 of the drawings illustrates a sample combination of an aquatic exercise assembly, including a plastic rod 14 and foam rubber discs 16 that are water absorbent. The discs 16 are held mounted concentrically onto rod 14 and held in position by plastic end caps 18 which are twistably detachable. Many combinations may be so obtained through the use of different length rods and various sizes of foam rubber discs.

Figure 4:
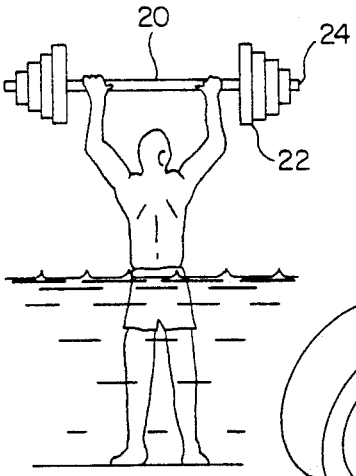
FIG. 4 of the drawings illustrates a use of the aquatic exercise assembly according to the present invention.

In FIG. 4, an example of one method of exercising with the aquatic exercise assembly is shown. A person standing in water is shown lifting the aquatic exercise assembly including a rod 20 upon which water absorbent foam rubber discs 22 are mounted, being held in position by end caps 24.

Figure 5:
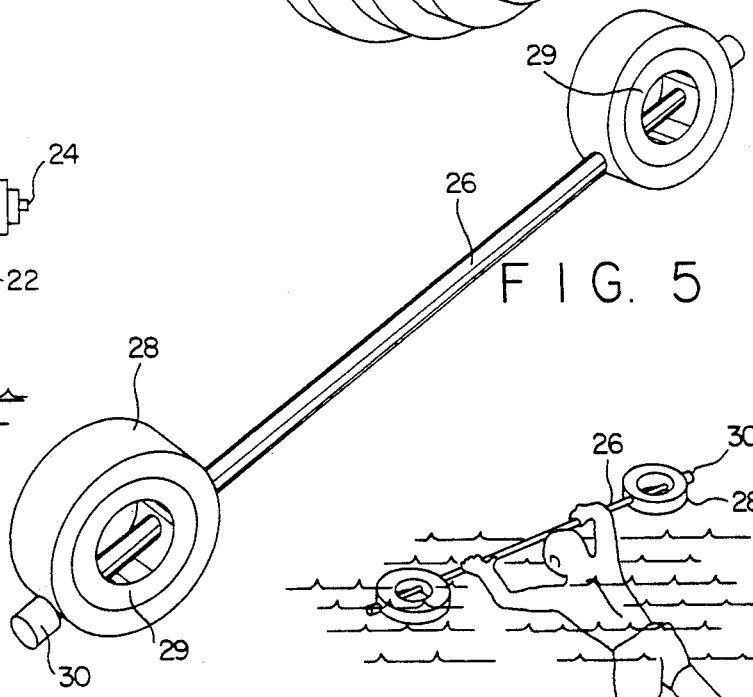
FIG. 5 of the drawings is a front view of a rod interchanged with nested floats according to the present invention.

Referring to FIG. 5 there is shown a rod 26 according to this invention having floats 28 and 29 attached on it. Floats 28 and 29 have been disclosed by prior U.S. Pat. No. 4,936,804. This aspect is a unique feature of the present invention, enabling a user to interchange various floats or various foam rubber discs with rods of various lengths as taught by the present invention. FIG. 5 illustrates a twin pod assembly wherein two floats 28 and 29 are on each end of rod 26 such that float 29 is positioned on rod 26 and nested within float 28. Floats 28 and 29 are held in position by end caps 30, as seen in FIG. 5.

Figure 6:
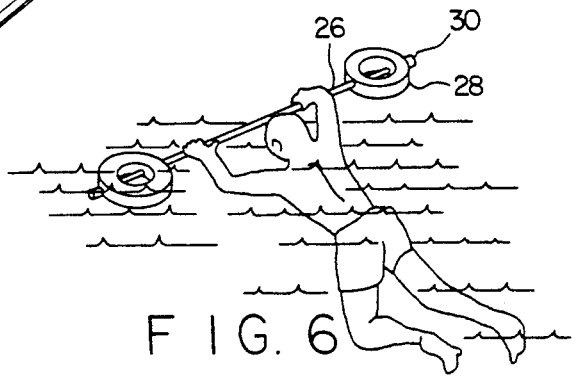
FIG. 6 of the drawings illustrates a use of the aquatic exercise assembly wherein a rod is interchanged with floats according to the present invention.

FIG. 6 illustrates a person utilizing one feature of the present invention. Floats 28 are shown attached to rod 26, being held in position by end caps 30. FIG. 6 shows how this novel feature of the present invention can be used as an aquatic exercise assembly by providing the desired degree of buoyancy through the addition of floats 28.

Figure 7:
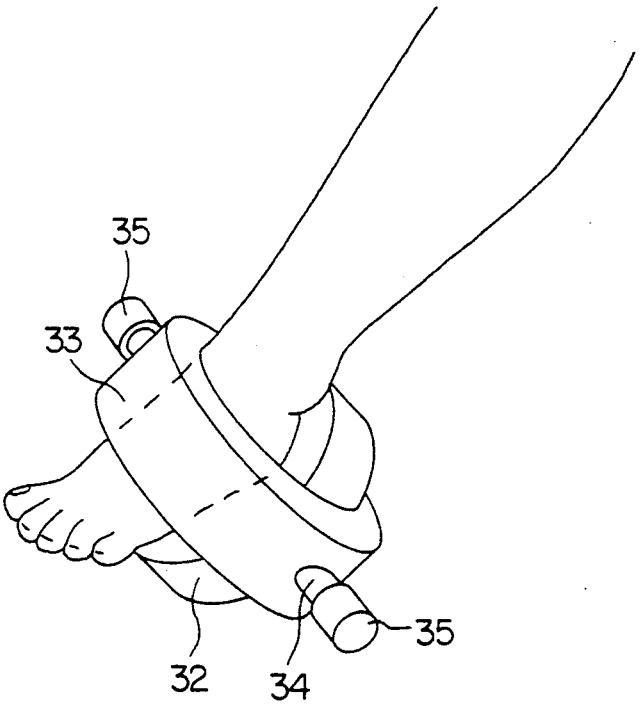
FIG. 7 of the drawings illustrates another use of the aquatic exercise assembly wherein a rod is interchanged with floats according to the present invention.

FIG. 7 illustrates a specific embodiment of the present invention wherein floats 32 and 33, disclosed by U.S. Pat. No. 4,936,804, are used with rod 34 as taught by the present invention. Floats 32 and 33 are shown mounted on a small rod 34, with float 32 positioned in a nested manner within float 33 but aligned on rod 34 in a position perpendicular to float 33. End caps 35 maintain floats 32 and 33 on rod 34. Once arranged this way, a person's foot can slip into the floats 32 and 33, as shown in FIG. 7. In this manner, the present invention can be used to provide sufficient buoyancy to allow a person in deep water to jog or engage in other exercise. This exercise can also be performed with only one float on each rod 34. Foam rubber discs (shown in FIG. 2) can also be used, as needed, to provide further weight and resistance, as they can be mounted on rod 34 along with floats 32 and 33.

It is thus seen that the aquatic exercise assembly in accordance with this invention provides a novel system for aquatic exercise which is adaptable for a variety of aquatic activities.

Also in accordance with the present invention, it is seen that the rods are interchangeable with floats as taught by U.S. Pat. No. 4,936,804 to enable a user to select many various combinations for the purpose of aquatic exercise. As variations will become apparent to those of skill in the art from a reading of the above description, such variations are embodied within the spirit and scope of the invention as defined by the following appended claims.

That which is claimed is:

1. A process of performing aquatic exercises comprising the following steps:

supplying a flotation apparatus, said apparatus comprising a rod, said rod supporting a float at either end of said rod, said floats retained on said rod by an attachable end cap at either end of said rod;

exercising in a body of water using said floatation apparatus;

removing said end cap from said rod;

removing further said floats from said rod;

sliding a disc-shaped weight member formed from foam rubber onto said rod, said disc-shaped member being water absorbent and increasing in weight to a predetermined amount when fully saturated, said disc-shaped member defining a circular opening in the central region thereof so as to mount slidably onto said rod;

replacing said end cap on said rod to retain said disc-shaped member;

exercising with said weight on said bar.

2. The process according to claim 1 comprising the additional step of:

installing an additional foam weight onto said bar, said foam weight slidably mounted over one of said attached end caps.

3. The process according to claim 1 comprising the additional step of removing a foam weight from said bar, said foam weight being slidably removable over said attached end cap.

* * * * *